United States Patent [19]

Ejiri et al.

[11] Patent Number: 4,747,380

[45] Date of Patent: May 31, 1988

[54] THROTTLE VALVE CONTROL DEVICE FOR INTERNAL COMBUSTION ENGINES

[75] Inventors: Yuki Ejiri; Tomoo Ito, both of Katsuta, Japan

[73] Assignee: Hitachi, Ltd., Tokyo, Japan

[21] Appl. No.: 888,408

[22] Filed: Jul. 23, 1986

[30] Foreign Application Priority Data

Jul. 31, 1985 [JP] Japan ..... 60-167595

[51] Int. Cl.[4] ..... F02B 77/00

[52] U.S. Cl. ..... 123/399; 123/198 D

[58] Field of Search ..... 123/399, 400, 403, 361, 123/198 D

[56] References Cited

U.S. PATENT DOCUMENTS 4,485,781 12/1984 Barnes ..... 123/198 D 4,523,565 6/1985 Omitsu ..... 123/399

FOREIGN PATENT DOCUMENTS 122742 7/1984 Japan ..... 123/399

*Primary Examiner*—E. Rollins Cross

*Attorney, Agent, or Firm*—Antonelli, Terry & Wands

[57] ABSTRACT

A throttle valve control device for an internal combustion engine controls an opening degree of a throttle valve by electrically drivingly rotating a rotary shaft, to which fixed is the throttle valve, in response to an angular movement of a speed acceleration pedal. The control device is actuated only in case of emergency. The control device is provided with a throttle valve returning mechanism for imparting a torque to cause the rotary shaft to rotate in a direction in which the throttle valve is fully closed.

4 Claims, 2 Drawing Sheets

THROTTLE VALVE CONTROL DEVICE FOR INTERNAL COMBUSTION ENGINES'

BACKGROUND OF THE INVENTION

1. Field of the Invention

The present invention relates to a throttle valve control device for internal combustion engines, and more particularly to a throttle valve returning mechanism for the throttle valve control device.

2. Description of the Prior Art

In general, a throttle valve control device of this type is constructed so that a control signal corresponding to an angular movement of an acceleration foot pedal is applied to a drive means to thereby adjust an opening degree of the throttle valve.

In the throttle valve control device shown in, for example, Japanese Patent Examined Publication No. 25853/1983, an electromagnetic clutch mechanism is disposed between a throttle valve shaft and a driving means, and the throttle valve is controlled by the driving means during the operation of the electromagnetic clutch mechanism. The electromagnetic clutch serves as a safety device, so that, if any operational failure is encountered in the driving means or the like, the clutch causes the throttle valve to be free from the control and the throttle valve is closed by a throttle valve closing spring.

However, in such a device, since the drive means must drive the throttle valve against the valve closing force of the throttle valve closing spring, an opening responsibility of the throttle valve tends to be slow. Efforts should be made to overcome this shortcoming.

SUMMARY OF THE INVENTION

An object of the present invention is to provide a throttle valve control device in which a closing torque of a throttle valve closing spring is not applied to the throttle valve when the driving means is operated in a normal or regular manner, but the valve closing torque is applied to the throttle valve upon emergency, thus enhancing the responsibility for the driving means to open the throttle valve in the normal operation.

According to the present invention, in a normal or regular state, a throttle valve shaft is released from a throttle valve closing spring adapted to urge the throttle valve in a closing direction, thus controlling the throttle valve shaft directly by the driving means, and only in case of emergency, the closing torque of the throttle valve closing spring is applied to the throttle valve shaft.

With such an arrangement, since the valve closing torque of the throttle valve closing spring is not applied to the driving means in the normal operational condition, the responsibility for the driving means to open the throttle valve is enhanced.

DETAILED DESCRIPTION OF THE PREFERRED EMBODIMENTS

Figure 1:
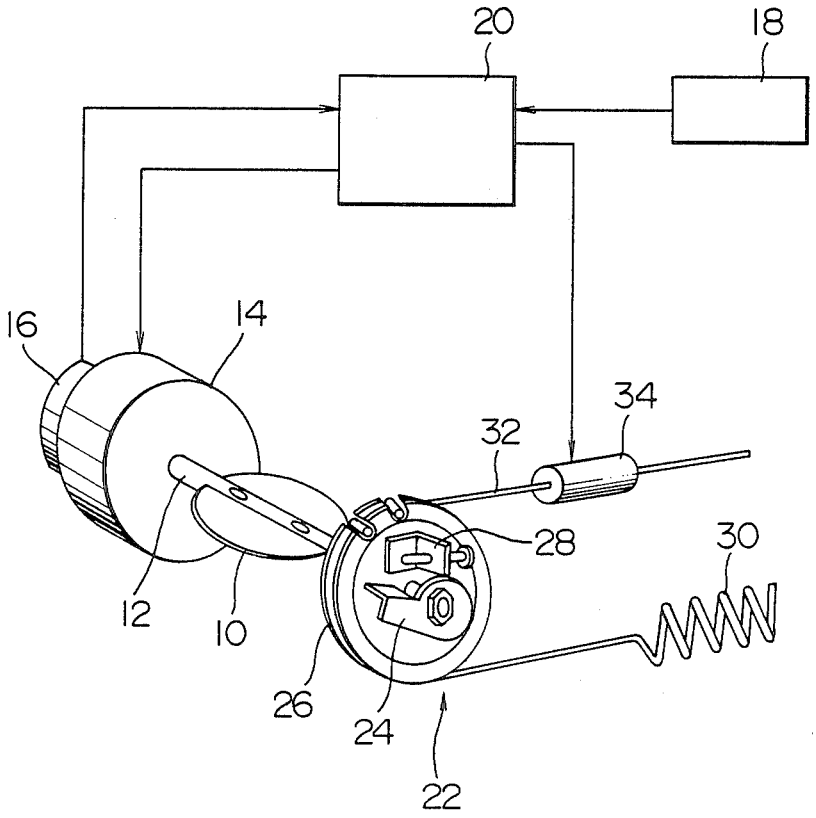
FIG. 1 is a perspective view of a throttle valve control device for an internal combustion engine in accordance with one embodiment of the invention.

In FIG. 1, a throttle valve 10 is disposed in an intake passage of an internal combustion engine (not shown). The throttle valve 10 is fixedly secured to a throttle valve shaft 12 extending in a transversal direction of the intake passage. A drive means 14 such as an electric motor is connected to one end of the throttle valve shaft 12. An opening degree sensor 16 is provided at the driving means 14 for detecting how much the throttle valve shaft 12 is being angularly rotated.

An output signal of an acceleration sensor 18 for detecting an angular movement of a speed acceleration pedal is inputted into a control unit 20 which may be a stored program type digital computer or the like. A signal from the control unit 20 is applied to the driving means 14 to change the opening degree of the throttle valve 10. On the other hand, the opening degree sensor 16 detects an actual angular movement of the throttle valve shaft 12. In the control unit 20, a comparison between the actual angular movement and the control opening degree is made to correct the angular movement of the throttle valve 12. It should be noted that the driving means 14 directly drives and controls the throttle valve shaft 12.

A throttle valve returning mechanism 22 is disposed on the side of the throttle valve shaft 12 opposite to the driving means 14. The throttle valve returning mechanism 22 comprises an abutment engagement lever 24 fixed to the end of the throttle valve shaft 12, a returning drum 26 rotatably mounted on the throttle valve shaft 12, a returning rod 28 fixed to the returning drum 26 and arranged to face the abutment engagement lever 24, a throttle valve closing spring 30 engaged with the returning drum 26, a wire 32 for rotating the returning drum 26 in a direction opposite to the biasing direction of the throttle valve closing spring 30, and a release unit 34 disposed in the wire 32 for releasing a tension of the wire 32.

In the above arrangement, since the wire 32 causes the returning drum 26 to rotate in the clockwise direction as viewed in FIG. 1 against the spring force of the throttle valve closing spring 30, the returning rod 28 is disengaged apart from the abutment engagement lever 24. Accordingly, the driving means 14 is not subjected to the valve closing torque of the throttle valve closing spring 30, and the opening degree of the throttle valve 10 can be controlled on the basis of the signal of the control unit 20.

In case of an emergency where the throttle valve 10 must be abruptly closed due to a break-down of the driving means 14 or the like, the control unit 20 applies a signal to the release unit 34 to thereby actuate the release unit of to release the tension of the wire 32. As a result, the returning drum 26 is rotated in the counterclockwise direction as viewed in FIG. 1 by the action of the throttle valve closing spring 30, so that the returning rod 28 is brought into contact with the abutment engagement lever 24 to close the throttle valve 10.

The release unit 34 may be of various types. For example, the release unit may be such that, in case of using a gunpowder, a tension is applied to the wire 32 at the time of the assembling of the release unit, and in case of emergency, the gunpowder is fired to cut the wire 32. Alternatively, the release unit 34 may be an electrical coupling such as a solenoid device having a coupling pin connected to the midportion of the wire so that the pin is released from the wire by the actuation of the solenoid, or may be of a type that the wire is released by the solenoid per se. However, the release unit is not limited to those types but can suffice if the tension of the wire 32 may be released in case of emergency.

Figure 2:
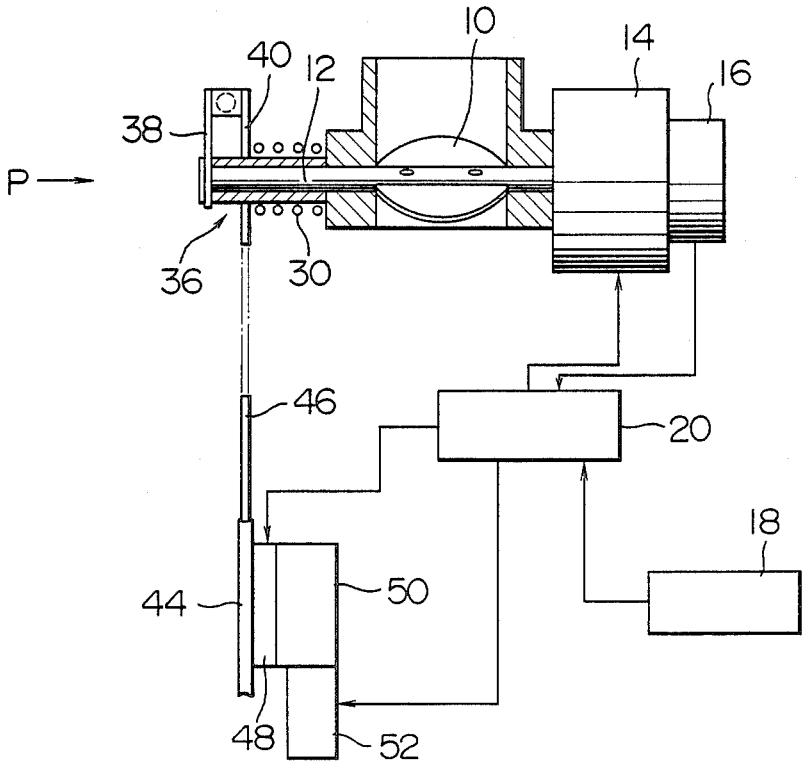
FIG. 2 is a partially cross-sectional, top plan view of a throttle valve control device for an internal combustion engine in accordance with another embodiment of the invention.

Another embodiment of the invention will now be described with reference to FIG. 2. In FIG. 2, the throttle valve 10, the throttle valve shaft 12, the driving means 14, the opening degree sensor 16, the acceleration sensor 18 and the control unit 20 are similar to those shown in FIG. 1. A distinction therebetween is present in the structure of the throttle valve returning mechanism.

In FIG. 2, the throttle valve returning mechanism 36 comprises an abutment engagement lever 38 fixed to the end of the throttle valve shaft 12 opposite to the driving means 14, a returning lever 40 rotatably mounted on the throttle valve shaft 12, a returning screw 42 threadedly engaged with the returning lever 40 and disposed in opposed relation with the engagement lever 38, a wire 46 having one end engaged with the returning lever 40 and the other end wound around a takeup drum 44, and an electric motor 52 which causes the takeup drum 44 to rotate through an electromagnetic clutch 48 and a speed reduction mechanism 50.

With the above arrangement, the control unit 20 applies its rotation signal to the electric motor 52 and also applies its exciting signal to the electromagnetic clutch 48 to rotate the takeup drum 44 and the motor 52 in cooperation. The rotation of the takeup drum 44 causes the returning lever 40 to rotate in the clockwise direction as viewed in FIG. 3. At this time, the returning lever 40 operates to tighten the throttle valve closing spring 30 wound around the throttle valve shaft 12.

Under such a condition, the throttle valve shaft 12 is not subjected to the closing torque of the throttle valve closing spring 30 and, as a result, the driving means 14 is also not subjected to the valve closing torque. The opening degree of the throttle valve 10 can be controlled in accordance with a signal from the control unit 20.

In case of emergency where the throttle valve 10 must be abruptly closed due to the break-down of the driving means 14 or the like, the control unit 20 applies its signal to extinguish the exciting magnetic force of the electromagnetic clutch 44, thereby releasing the cooperation between the electric motor 52 and the takeup drum 44.

Figure 3:
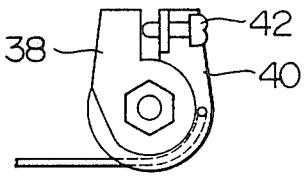
FIG. 3 is a view as viewed in a direction indicated by P in FIG. 2.

As a result, the takeup drum 44 and the wire 46 are free from the electric motor 52 and are rotated in the counterclockwise direction as viewed in FIG. 3 by the throttle valve closing spring 30. Then, the returning screw 42 is brought into contact with the engagement lever 38 to close the throttle valve 10.

As has been described, according to the present invention, in the normal condition, the force of the throttle valve closing spring is not applied to the driving means, so that the responsibility for causing the driving means to open the throttle valve can be improved, whereas, in case of emergency, the throttle valve closing spring acts on the throttle valve shaft to ensure the safety aspect.

What is claimed is:

1. In a throttle valve control device for controlling a position of an engine throttle valve secured to a rotary shaft, which includes a control unit operative to produce a first electrical signal in accordance with a movement of an engine accelerator and an electro-mechanical force transducer operative to impart a first rotational torque to said rotary shaft and thereby to said throttle valve, said first rotational torque corresponding to said first electrical signal, the improvement comprising:

a throttle valve returning means operative to produce a second rotational torque for biasing said throttle valve to a fully closed position irrespective of the movement of said engine accelerator;

said control unit having means to produce a second electrical signal when the engine is in an emergency condition; and means responsive to said second electrical signal to transmit said second rotational torque to said rotary shaft irrespective of the movement of said engine accelerator.

2. A throttle valve device for an internal combustion engine, comprising:

(a) a throttle valve shaft extending through an intake passage in a transversal direction of the intake passage;

(b) a throttle valve for controlling a flow rate of an intake mixture flowing through said intake passage, said throttle valve being fixed to said throttle valve shaft;

(c) a driving means for controlling said throttle valve shaft at a desired opening degree in cooperation of one end of said throttle valve shaft;

(d) a control unit for applying control signals to said driving means;

(e) a throttle valve closing spring for biasing said throttle valve shaft to cause said throttle valve in its closing direction; and (f) a throttle valve returning mechanism for releasing a cooperation between said throttle valve closing spring and said throttle valve shaft under a normal operational condition and for causing said throttle valve closing spring and said throttle valve shaft to cooperate with each other in case of emergency.

3. A throttle valve device according to claim 2, wherein said throttle valve returning mechanism comprises:

(a) an abutment engagement lever fixed to the other end of said throttle valve shaft;

(b) a returning drum rotatably supported to said throttle valve shaft;

(c) a returning rod fixed to said returning drum and arranged to face said abutment engagement lever;

(d) the throttle valve closing spring applying a rotational torque to said returning drum to close said throttle valve;

(e) an opening means for biasing to rotate said returning drum in an opposite direction to a spring force of said throttle valve closing spring and to separate said abutment engagement lever and said returning rod from each other; and (f) a release unit for releasing the biasing force of said opening means, said release unit being interposed in said opening means.

4. A throttle valve device according to claim 2, wherein said throttle valve returning mechanism comprises:

(a) an abutment engagement lever fixed to the other end of said throttle valve shaft;

(b) a returning lever rotatably supported to said throttle valve shaft and arranged to face said abutment engagement lever;

(c) the throttle valve closing spring applying a rotational torque to said returning lever to close said throttle valve;

(d) an opening means for biasing said returning lever to cause said throttle valve to open;

(e) an accumulation means for driving said opening means and accumulating a spring energy of said throttle valve closing spring; and (f) a release unit for releasing said opening means from said accumulation means in case of emergency, said release unit being interposed between said opening means and said accumulation means.

* * * * *